US006461432B1

(12) United States Patent
Stash et al.

(10) Patent No.: US 6,461,432 B1
(45) Date of Patent: Oct. 8, 2002

(54) CERAMIC RAM FILM COATING PROCESS

(75) Inventors: Sandra J. Stash, Stanton, CA (US); Mark E. Cooper, Vancouver, WA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/415,850

(22) Filed: Oct. 7, 1999

Related U.S. Application Data

(62) Division of application No. 08/889,785, filed on Jul. 8, 1997, now Pat. No. 6,001,425.

(51) Int. Cl.[7] ..... B05C 3/00
(52) U.S. Cl. ..... 118/429; 118/612; 118/602
(58) Field of Search ..... 118/429, 50, 612, 118/602, 428; 427/430.1, 443.2

(56) References Cited

U.S. PATENT DOCUMENTS

| | | | | |
|---|---|---|---|---|
| 1,818,976 A | | 8/1931 | Goff | 427/435 |
| 2,747,008 A | | 5/1956 | Sundberg et al. | 427/443.2 |
| 3,448,719 A | | 6/1969 | Tate | 427/443.2 |
| 3,873,350 A | | 3/1975 | Dwyer et al. | 427/443.2 |
| 4,084,161 A | | 4/1978 | Manning et al. | 343/18 |
| 4,102,304 A | | 7/1978 | Debenham | 118/421 |
| 4,208,454 A | | 6/1980 | Reed et al. | 427/238 |
| 4,468,420 A | | 8/1984 | Kawahara et al. | 427/397.7 |
| 4,686,121 A | | 8/1987 | Rogalla | 427/378 |
| 4,964,366 A | * | 10/1990 | Kurokawa et al. | |
| 5,089,299 A | | 2/1992 | Van 'T Veen et al. | 427/245 |
| 5,091,222 A | | 2/1992 | Nishio et al. | 427/335 |
| 5,167,813 A | | 12/1992 | Iwata et al. | 210/219 |
| 5,681,392 A | * | 10/1997 | Swain | |

* cited by examiner

*Primary Examiner*—Brenda A. Lamb
(74) *Attorney, Agent, or Firm*—Stetina Brunda Garred & Brucker

(57) ABSTRACT

A uniform coating of radar-absorbing material (RAM) is produced on small or intricate parts by suspending the part in a vessel, slowing filling the vessel with RAM slurry without turbulence from the bottom up, subsequently draining the slurry slowly without turbulence to leave a coating of RAM on the part, and repeating the process until a coating of sufficient thickness is obtained.

13 Claims, 5 Drawing Sheets

FIG. 4b
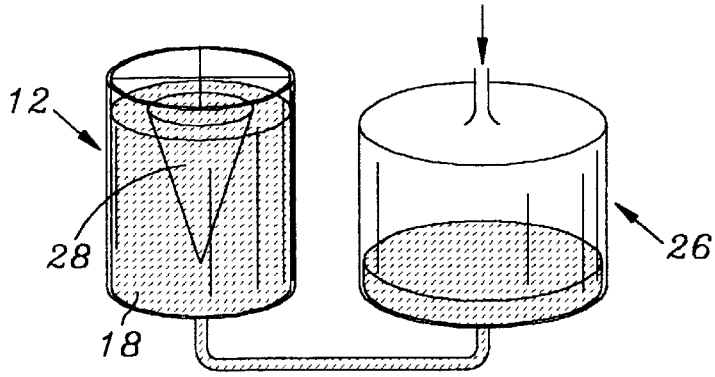
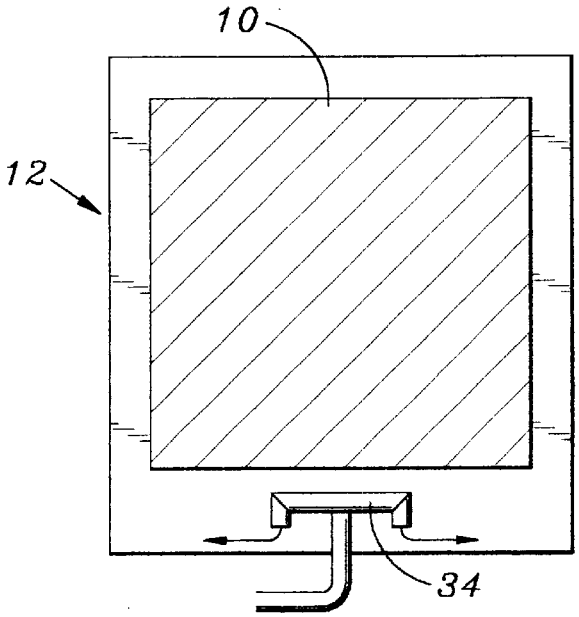
FIG. 6
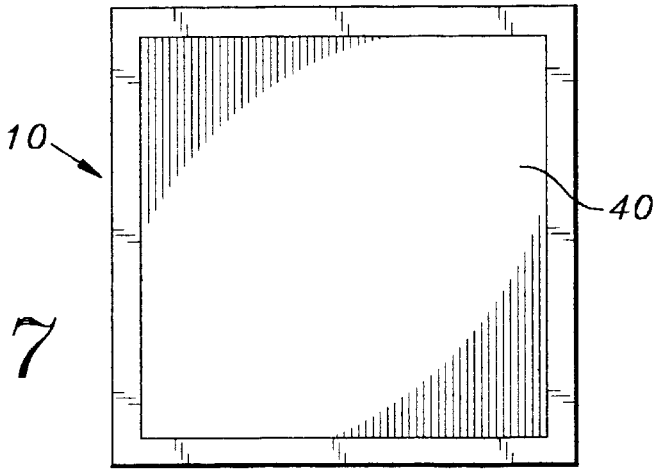
FIG. 7

CERAMIC RAM FILM COATING PROCESS

This application is a divisional of Ser. No. 08/889,785 filed Jul. 8, 1997, now U.S. Pat. No. 6,001,425.

FIELD OF THE INVENTION

This invention relates to a coating process for intricate parts, and more specifically to a process for coating parts with a ceramic radar-absorbing material (RAM) by flooding a vessel containing the part with a RAM slurry.

BACKGROUND OF THE INVENTION

In many military applications, there is a strong need to make aircraft, vehicles and other objects, including their component parts, as invisible to radar as possible. A number of techniques for accomplishing this purpose are well known. One such technique is to coat metallic parts with a ceramic radar-absorbing material.

Conventionally, the ceramic RAM is suspended in particulate form in a wet slurry which is sprayed onto the substrate of the part to be processed. Although this process is easy to use and is performable with readily available equipment, and has proven generally suitable for its intended purpose, it possesses inherent deficiencies which detract from its overall effectiveness and desirability. Specifically, the spray process has several disadvantages: for one, coatings of small, complex parts or parts with small internal diameters are difficult to obtain consistently; secondly, the spray process does not lend itself well to automation because variables such as coating thickness are difficult to control; and thirdly, a sprayed coating sometimes has difficulty adhering to the part with the result that electromagnetic performance is degraded.

Furthermore, because the slurry is a mixture of heavy and light particulates, it is important to maintain the slurry in a homogenous consistency. This can be done by maintaining the slurry in an agitated and/or flowing state, which keeps the heavier particles in suspension.

Other prior art methods include the following:

Nishio et al. U.S. Pat. No. 5,091,222 describes a method of ceramic coating in which the workpiece is dipped into a ceramic solution;

Van 'T Veen et al. U.S. Pat. No. 5,089,299 shows apparatus for applying a micropore coating to a ceramic substrate, in which the workpiece is moved with respect to the ceramic suspension. This is undesirable because movement of the part can disrupt the uncured coating.

Reed et al. U.S. Pat. No. 4,208,454 shows a coating process in which an alumina slurry is forced though a workpiece by a vacuum.

In view of the shortcomings of the prior art, it is desirable to provide a process which will uniformly coat parts regardless of their size or complexity, and will not be subject to the inherent inconsistencies arising from variations in spray patterns and from non-homogenity of the slurry. In this regard, although the prior art has recognized to a limited extent the nature of this problem, the proposed solutions have, to date, been ineffective in providing a satisfactory remedy.

SUMMARY OF THE INVENTION

The present invention specifically addresses and alleviates the above mentioned deficiencies associated with the prior art. More particularly, the present invention comprises positioning the part in a vessel, and flooding the vessel with a uniformly rising level of RAM slurry. When the part has become completely submerged, the RAM slurry is drained from the vessel, and the coated part is cured or dried. The process may be repeated as often as desired to obtain a thicker coating.

In the preferred embodiments of the invention, even flooding and recycling of the RAM slurry is obtained by introducing the slurry, and also removing it, from the bottom of the vessel. The slurry is preferably stored in a variable-volume container which is preferably subjected to pressure to force the slurry into the vessel, and to a vacuum or positive-displacement device to draw the slurry out of the vessel. This method not only allows the slurry to be readily reused from one part to the next but it also allows it to be stored in a sealed, contamination-free container.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIGS. 4*a* through 4*c* are schematic perspective views of an apparatus carrying out the three basic sequential steps of the inventive method;

FIG. 6 is an elevation illustrating a modification of the embodiment of FIG. 5;

FIG. 7 is an elevation of a sample panel showing a preferred embodiment of protection for the back of the sample panel;

DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
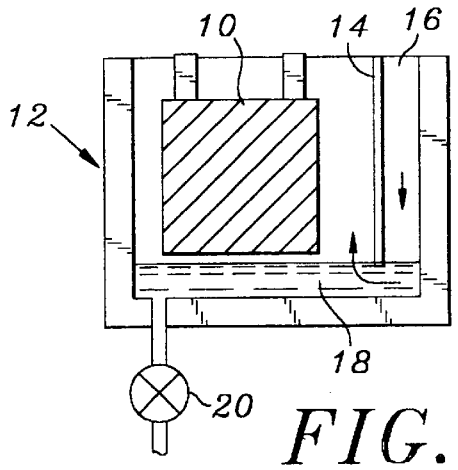
FIG. 1 is an elevation of a first embodiment illustrating a basic aspect of the invention.
Figure 2:
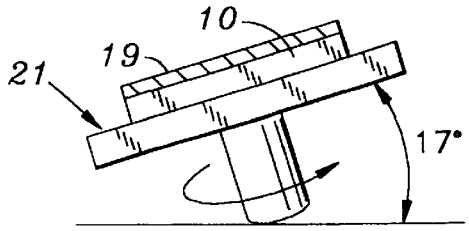
FIG. 2 is a side elevation of an inclined turntable illustrating a step in a method of coating parts in accordance with the invention.

FIG. 1 shows the invention in its most basic form. A panel 10 to be coated with ceramic RAM is suspended in a vessel 12 of an appropriate inert material such as Plexiglas. A partition 14 separates the panel 10 from an inlet 16 through which a RAM slurry 18 is introduced into the vessel 12. The slurry 18 flows around the bottom end of partition 14 and gradually rises in the vessel 12 until it covers the panel 10. After a short dwell time, during which the panel 10 is fully immersed in the slurry 18, the drain valve 20 is opened. The slurry 18 then flows slowly out of the vessel 12 and leaves on the panel 10 a thin coating 19 (FIG. 2) of RAM.

The slurry is preferably a ceramic slurry containing a combination of very dense and light metallic particles, as is well known in the art. Preferably, it is introduced into the vessel 12 at a rate which causes the level of slurry 18 in the vessel to rise about 0.5–1.0 cm per minute, producing a homogeneous and even coating. After a dwell time of about 1 min., the slurry 18 is drained at the same rate.

A single application of slurry will deposit only a thin RAM coating. The thickness of the coating varies between about 0.13 and 0.25 mm depending upon the viscosity of the slurry, which typically ranges from 100 to 10,000 centripoise. Consequently, it is desirable to repeat the process several times until the desired thickness has been built up. The panel 10 may then be placed, if desired, on a rotating table 21 (FIG. 2) which may advantageously be rotated at a about 3 rpm at an inclination of about 17° to evenly distribute the coating by cold flow. When a sufficient thickness of coating has been built up, the panel 10 may then be heated to cure the ceramic.

Figure 3:
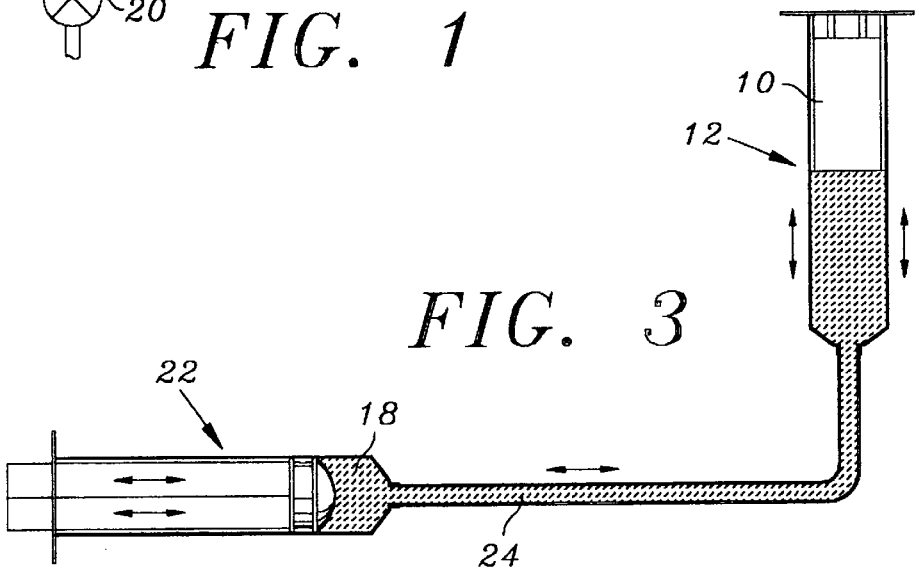
FIG. 3 is a schematic view of an embodiment illustrating certain principles of the invention.

Because the single use of the slurry exemplified by the embodiment of FIG. 1 is wasteful, it is preferable to reuse it by a system illustrated basically in FIG. 3. In that figure, the slurry 18 is stored in an appropriate reciprocatable apparatus 22 which is connected through a conduit 24 to the bottom of the vessel 12 in which the panel 10 is suspended. Pushing the plunger of the device 22 injects the slurry 18 into the vessel 12 at a fully controllable rate, while withdrawing the plunger causes the slurry to be returned into the device 22 at an also fully controllable rate.

Figure 4A:
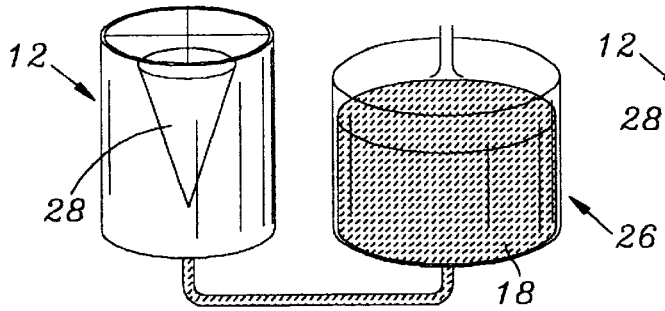
Figure 4C:
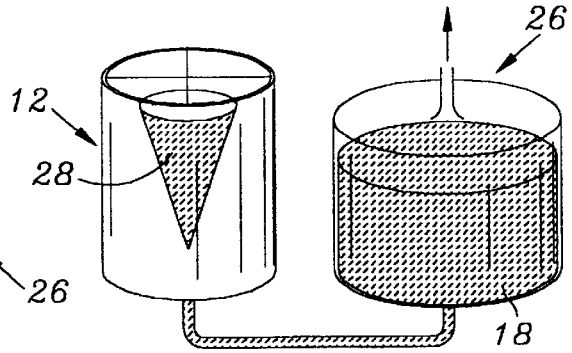

FIGS. 4*a* through 4*c* illustrate, in a schematic fashion, a more practical version of this concept. In FIG. 4*a*, a slurry tank 26 is pressurized to force the slurry 18 into the vessel 12 (FIG. 4*b* ). After the workpiece 28 has been coated, a vacuum is applied to the tank 26 and the slurry is returned to the tank 26 (FIG. 4*c* ).

Figure 5A:
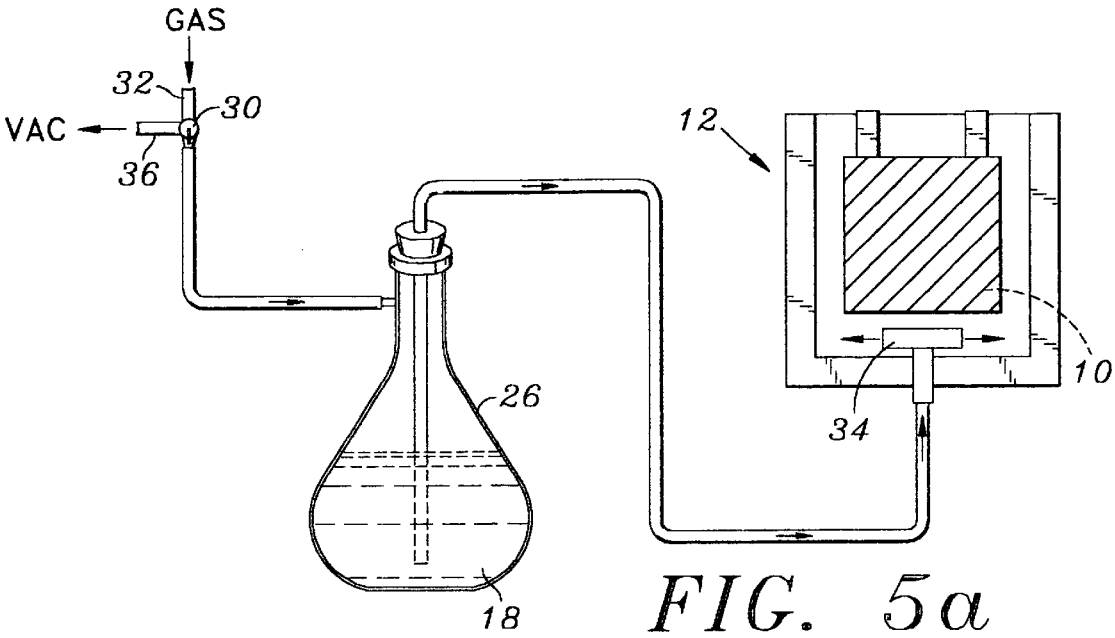
FIGS. 5*a* and 5*b* are elevations of another embodiment carrying out the teachings of the invention.
Figure 5B:
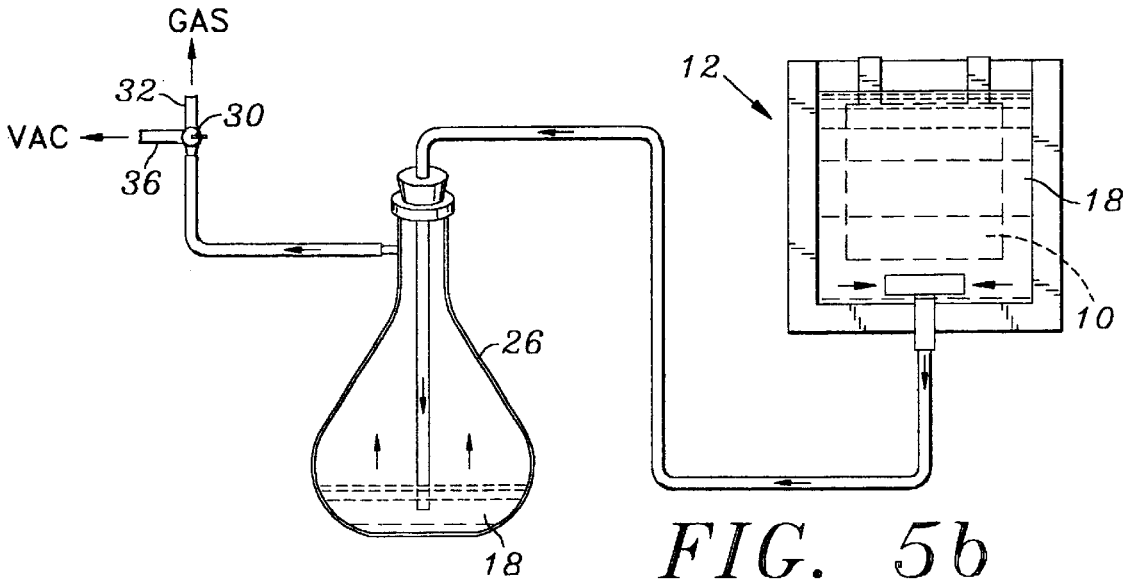

A practical application of this principle to the embodiment of FIG. 1 is shown in FIGS. 5*a* and 5*b*. In FIG. 5*a* the valve 30 is opened to a supply 32 of inert gas, forcing the slurry 18 in tank 26 into the vessel 12. In FIG. 5*b*, the valve 30 is switched to the vacuum supply 36, and the slurry 18 is sucked out of the vessel 12.

It is important for the uniformity of the coating on panel 10 that the slurry 18 rise uniformly in vessel 12 without causing any flow patterns on panel 10. To this end, it may be preferable to terminate the T fitting 34 in downwardly pointing outlets, so that any flow turbulence will be confined to the bottom of the vessel 12 (FIG. 6).

Some parts, such as electronic circuitry, may have to be protected from the slurry 18 during the coating of the substrate exemplified by panel 10. This is typically done by a plastic coating to which the ceramic RAM does not adhere. However, as shown in FIG. 7, the plastic coating 40 is preferably confined to an area no closer than about 1 cm from the edge of panel 10, as there is a danger that solvents in the plastic coating 40 on the back side of panel 10 may migrate around the edge of panel 10 during the cure, and interfere with the adhesion of the RAM coating to the front side of panel 10.

Figure 8:
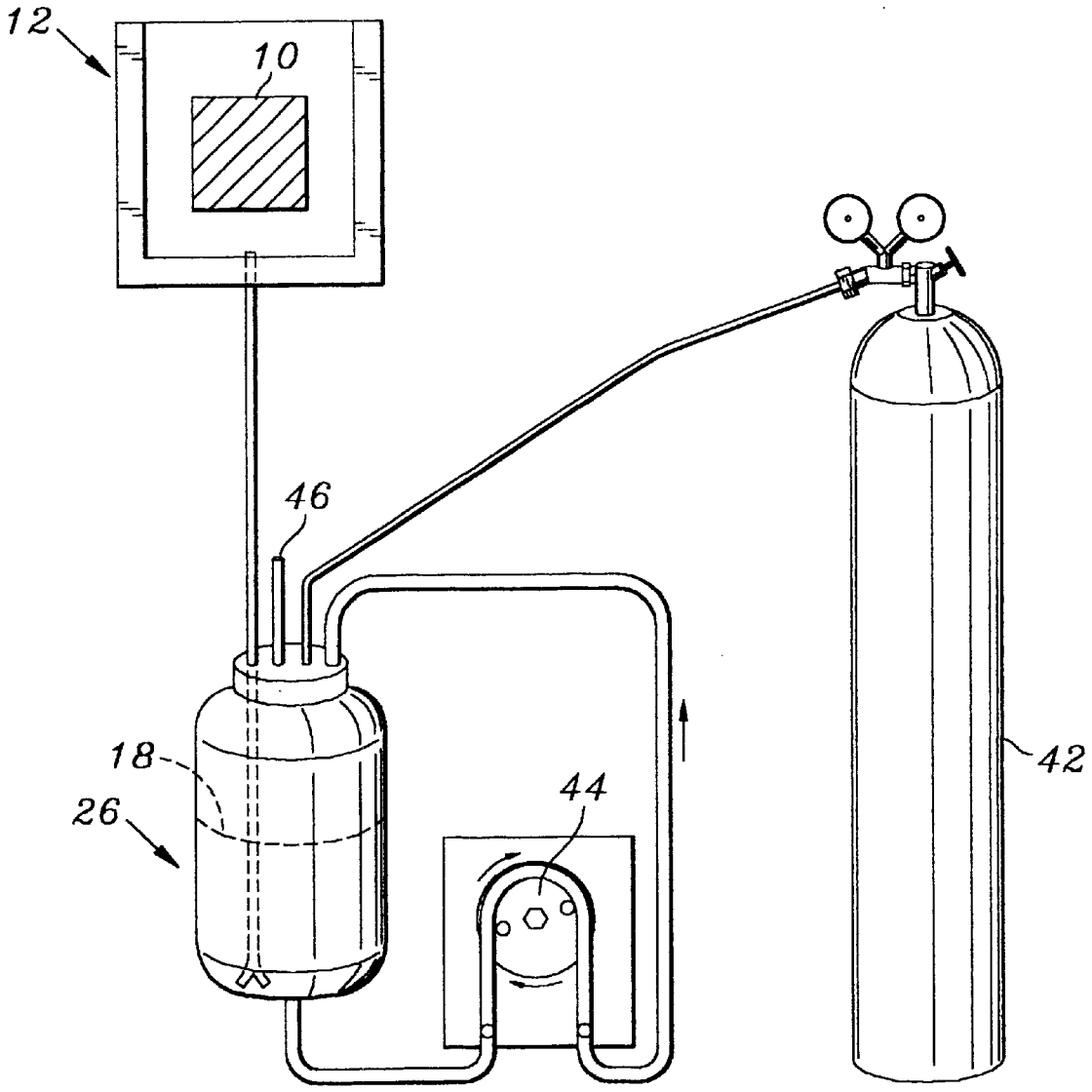
FIG. 8 is a schematic view of an arrangement for maintaining circulation of the slurry during the use of the invention.

To avoid a settling of the slurry 18, it may be advantageous to use a system such as that shown in FIG. 8. In that figure, a compressed inert gas 42 such as nitrogen may be used to provide the pressure to force slurry from the tank 26 into the vessel 12. The slurry 18 in the tank 26 is continuously circulated by a pump such as the roller pump 44 depicted in FIG. 8. To withdraw the slurry 18 from the vessel 12, the pressurizing nitrogen gas may simply be vented at 46, or a vacuum may be applied to the line 46.

Figure 9:
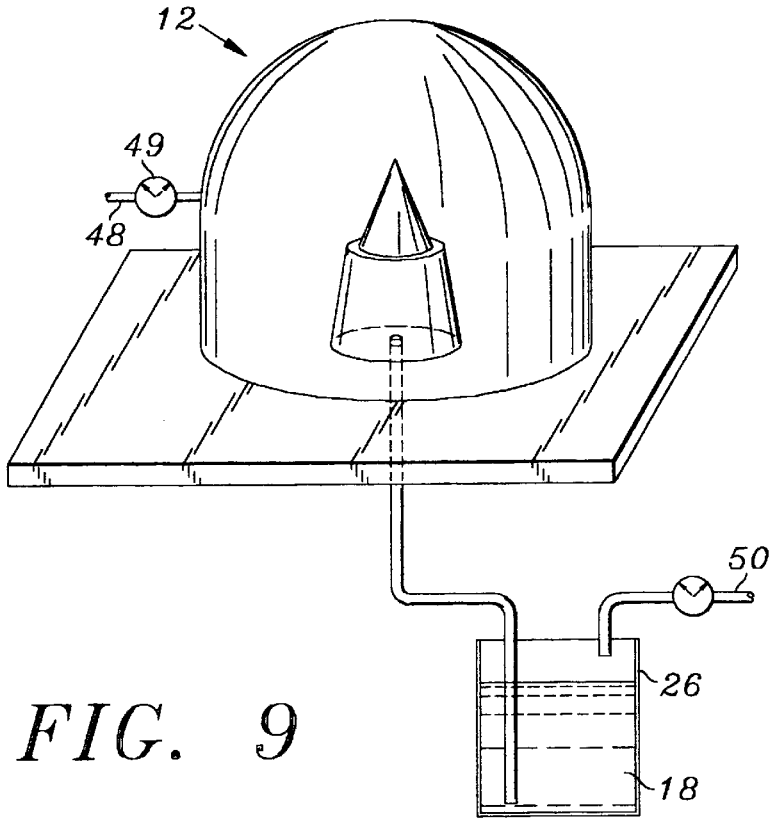
FIG. 9 is a schematic view of a dual pressure embodiment of the invention.

FIG. 9 illustrates a further refinement of the invention. In accordance with that modification, the vessel 12 is closed, and separate pressure sources 48, 50 are applied to the vessel 12 and the tank 26, respectively. This approach has several advantages: for one, it allows the introduction into vessel 12 of inert gases such as nitrogen or argon to prevent skinning (i.e. the formation of a dried film or skin on the surface of the coating) and to promote drying of the coating; and for another, it allows emptying of the vessel 12 by positive pressure from source 48 rather than by a vacuum from source 50. This reduces loss of volatiles in the slurry 18 while maintaining the slurry 18 free from contamination.

As shown in FIG. 9, the vessel 12 can be filled by making the pressure at 48 smaller than that at 50 (solid lines on gauges 49, 51), and emptied by making the pressure at 48 greater than that at 50 (dotted lines on gauges 49, 51).

Figure 10A:
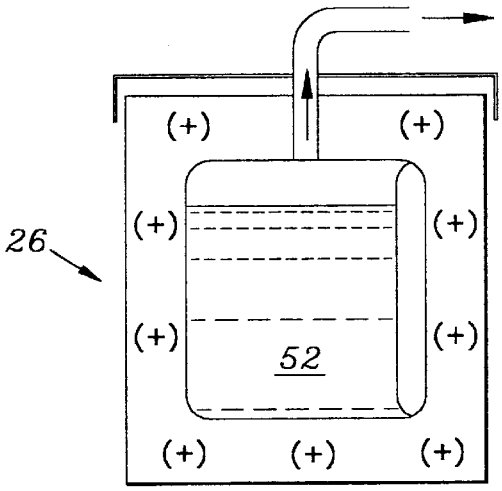
FIGS. 10*a* and 10*b* schematically illustrate a plasma bag embodiment of the invention.
Figure 10B:
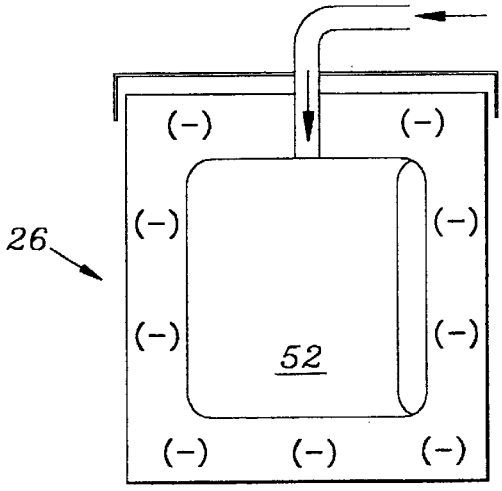

In the foregoing embodiments, the natural agitation caused by the flow of the slurry has been used to maintain its particulates in suspension. Another method of agitating the slurry 18 is shown in FIG. 10, in which a plasma bag 52 is enclosed in the tank 26. As the pressure in tank 26 is increased, the bag 52 is deformed from all sides, thus maintaining the slurry 18 agitated during the filling and emptying of vessel 12 without allowing the pressure medium to aerate it.

It is understood that the exemplary ceramic RAM film coating process as described herein and shown in the drawings represents only presently preferred embodiments of the invention. Indeed, various modifications and additions may be made to such embodiments without departing from the spirit and scope of the invention. Thus, other modifications and additions may be obvious to those skilled in the art and may be implemented to adapt the present invention for use in a variety of different applications.

What is claimed is:

1. Apparatus for coating a part with a ceramic radar absorbing material (RAM), comprising:

a) a vessel;

b) means for suspending in said vessel a part to be coated;

c) a source of ceramic RAM slurry, including a pressurizable tank;

d) means to pressurize said tank to force said slurry into said vessel and to depressurize said tank to withdraw said slurry from said vessel;

e) means for gradually introducing said slurry from said source into said vessel substantially at the bottom thereof so as to cause the level of said slurry in said vessel to rise substantially without turbulence around said part until said part is immersed in said slurry; and f) means for gradually draining said slurry from said vessel so as to coat said part with a uniform film of ceramic RAM.

2. The apparatus of claim 1, in which said depressurizing means is a vacuum.

3. The apparatus of claim 1, further comprising means for agitating said slurry during introduction of said slurry into said vessel.

4. The apparatus of claim 3, which said agitating means include a slurry recirculating pump.

5. The apparatus of claim 3, in which said agitating means include an externally pressurized plasma bag.

6. Apparatus for coating a part with a ceramic radar absorbing material (RAM), comprising:

a) a pressurizable vessel;

b) means for suspending in said vessel a part to be coated;

c) a source of ceramic RAM slurry;

d) means for gradually introducing said slurry from said source into said vessel substantially at the bottom thereof so as to cause the level of said slurry in said vessel to rise substantially without turbulence around said part until said part is immersed in said slurry; and e) means for gradually draining said slurry from said vessel so as to coat said part with a uniform film of ceramic RAM;

f) wherein said slurry introducing and draining means include means for biasing said slurry to flow into said vessel and pressure means for biasing said slurry to flow out of said vessel, the relative strength of said biasing means being adjustable to selectively introduce said slurry into said vessel and withdraw it therefrom.

7. The apparatus of claim 1, in which said slurry is so introduced into, and drained from, said vessel that the level of slurry in said vessel rises and falls at a rate of substantially 0.5–1.0 cm/min.

8. The apparatus of claim 6, in which said source of ceramic RAM slurry is a pressurizable tank, and in which means are provided to pressurize said tank to force said slurry into said vessel and to depressurize said tank to withdraw said slurry from said vessel.

9. The apparatus of claim 6, in which said depressurizing means is a vacuum.

10. The apparatus of claim 6, further comprising means for agitating said slurry during introduction of said slurry into said vessel.

11. The apparatus of claim 10, in which said agitating means include a slurry recirculating pump.

12. The apparatus of claim 10, in which said agitating means include an externally pressurized plasma bag.

13. The apparatus of claim 6, in which said slurry is so introduced into, and drained from, said vessel that the level of slurry in said vessel rises and falls at a rate of substantially 0.5–1.0 cm/min.

* * * * *